US007465263B1

(12) United States Patent
Conrad et al.

(10) Patent No.: US 7,465,263 B1
(45) Date of Patent: Dec. 16, 2008

(54) SYSTEM FOR EXERCISE AND CHILD DEVELOPMENT

(75) Inventors: Curt Conrad, Mason, OH (US); Elizabeth A. Brougher, Loveland, OH (US); Debbie A. Schmidt, Edgewood, KY (US); Susan E. Sherman, Cincinnati, OH (US)

(73) Assignee: StrollerFit, Inc., Cincinnati, OH (US)

( * ) Notice: Subject to any disclaimer, the term of this patent is extended or adjusted under 35 U.S.C. 154(b) by 35 days.

(21) Appl. No.: 11/244,977

(22) Filed: Oct. 6, 2005

(51) Int. Cl.
*A63B 71/00* (2006.01)

(52) U.S. Cl. ..... 482/148; 482/23; 434/393; 446/227

(58) Field of Classification Search ..... 482/148, 482/140, 23
See application file for complete search history.

(56) References Cited

U.S. PATENT DOCUMENTS

| | | | | |
|---|---|---|---|---|
| 4,000,905 | A | 1/1977 | Shirhall | |
| 4,039,186 | A | 8/1977 | Anderson | |
| 4,805,913 | A | 2/1989 | Bott | |
| 4,915,387 | A | 4/1990 | Baxstrom | |
| 4,982,959 | A * | 1/1991 | Rudell et al. | 273/443 |
| 5,156,409 | A * | 10/1992 | Barnes | 273/444 |
| 5,330,176 | A | 7/1994 | Cagney, Jr. | |
| 5,507,495 | A | 4/1996 | Kiss | |
| 5,642,880 | A * | 7/1997 | Wiseman et al. | 473/417 |
| 5,836,835 | A * | 11/1998 | Grimsley | 473/414 |
| 6,102,818 | A | 8/2000 | Hamilton | |
| 6,387,013 | B1 | 5/2002 | Marquez | |
| 6,631,905 | B1 | 10/2003 | Slade | |
| 6,723,004 | B1 | 4/2004 | Florian | |
| 6,751,816 | B1 | 6/2004 | Wechsler | |
| 2002/0098947 | A1 | 7/2002 | Brown | |
| 2004/0229731 | A1 | 11/2004 | Mitchell | |
| 2005/0070370 | A1 * | 3/2005 | Whitaker | 473/266 |
| 2005/0112538 | A1 | 5/2005 | Pinkins | |

FOREIGN PATENT DOCUMENTS

| | | | |
|---|---|---|---|
| GB | 2 198 635 | A | 6/1988 |
| GB | 2 351 836 | A * | 1/2001 |
| GB | 2 395 669 | A | 6/2004 |

* cited by examiner

*Primary Examiner*—Lori Amerson
(74) *Attorney, Agent, or Firm*—Ice Miller LLP

(57) ABSTRACT

A system and a method for exercise and/or child development for use by an adult and a child. The system and method utilize a mat or other surface upon which exercises are performed. Such a surface is sized to permit an adult to perform exercises thereon. Such a surface has a plurality of indicia marked thereon. The system and method further utilize instructions describing at least one exercise and/or child development activity. The exercise and/or child development activity incorporates the mat and its indicia.

2 Claims, 17 Drawing Sheets

SYSTEM FOR EXERCISE AND CHILD DEVELOPMENT

BACKGROUND

During pregnancy, a mother's musculature becomes unbalanced to accommodate the growing baby. The muscles of the mother's pelvic floor and those of the mother's abdomen are stretched beyond their normal range. Other muscles, such as those of the mother's lower back, buttocks, shoulders, and neck, also undergo abnormal stresses as the changing shape of the mother's body requires different and more strenuous movements to accomplish even the simplest of tasks.

After pregnancy, a mother's body changes as well. The muscles of the mother's pelvic floor and those of the mother's abdomen are left weakened and over-stretched. A mother also spends a tremendous amount of time bending and stretching to pick up and carry the baby, pick up baby toys, install baby gear, and the like. The load from these activities and the resultant stress on the mother's body increases as the child grows and becomes more active. Injury and/or chronic pain may result.

Post-natal exercise frequently is recommended for new mothers in an attempt to restore strength and muscle tone to the mother's body. However, a problem arises in that the demands on a mother's time from children and the mother's other responsibilities frequently prevent the mother from engaging in a regular exercise program. In addition, mothers often are reluctant to leave babies, toddlers, or young children with another party while engaging in an exercise program. If a mother attempts to exercise in the presence of her baby, toddler, or young child, it is often the case that the baby, toddler, or young child will become distracted by the surroundings. This, in turn, will distract the mother from her program of exercise.

For the foregoing reasons, it is desired to provide a system for exercise addressing the needs of mothers of babies, toddlers, and/or young children. The desired system will aid new mothers in restoring strength and muscle tone to the mother's body. The desired system also will include features attractive to and educational for babies, toddlers, and young children. By use of the desired system, a mother will be able to engage in an exercise program while engaging her baby, toddler, and/or young child in educational and developmental activities.

SUMMARY

A system for exercise and/or child development for use by adults and children is disclosed. Such a system comprises a first surface and instructions describing at least one exercise and/or child development activity using the first surface. The first surface is sized to permit an adult to perform exercises thereon, and comprises a plurality of indicia. The at least one exercise and/or child development activity may comprise the use of at least one of the plurality of indicia. Such a system may comprise at least one prompting mechanism comprising at least one of the indicia and at least one of the instructions. Such a prompting mechanism may comprise cards, DVD, CD, or computer program. Such a system may comprise a second surface. Such a second surface is sized to permit a child to perform exercises thereon, and comprises a plurality of indicia.

A method for exercise and/or child development for use by adults and children is disclosed. Such a method comprises the steps of providing a first surface, providing instructions describing at least one exercise and/or child development activity using the first surface, and directing performance of the at least one exercise and/or child development activity using the first surface in accordance with the instructions. The first surface is sized to permit an adult to perform exercises thereon, and comprises a plurality of indicia. In such a method system, the step of directing performance of the at least one exercise and/or child development activity may comprise the step of directing placement of at least one human appendage in contact with at least one of the plurality of indicia. Such a system may further comprise the step of providing a second surface. Such a second surface is sized to permit a child to perform exercises thereon, and comprises a plurality of indicia.

BRIEF DESCRIPTION OF THE DRAWINGS

The features and advantages of these inventions, and the manner of attaining them, will be more apparent and better understood by reference to the following descriptions taken in conjunction with the accompanying drawings, wherein.

DESCRIPTION

Figure 1:
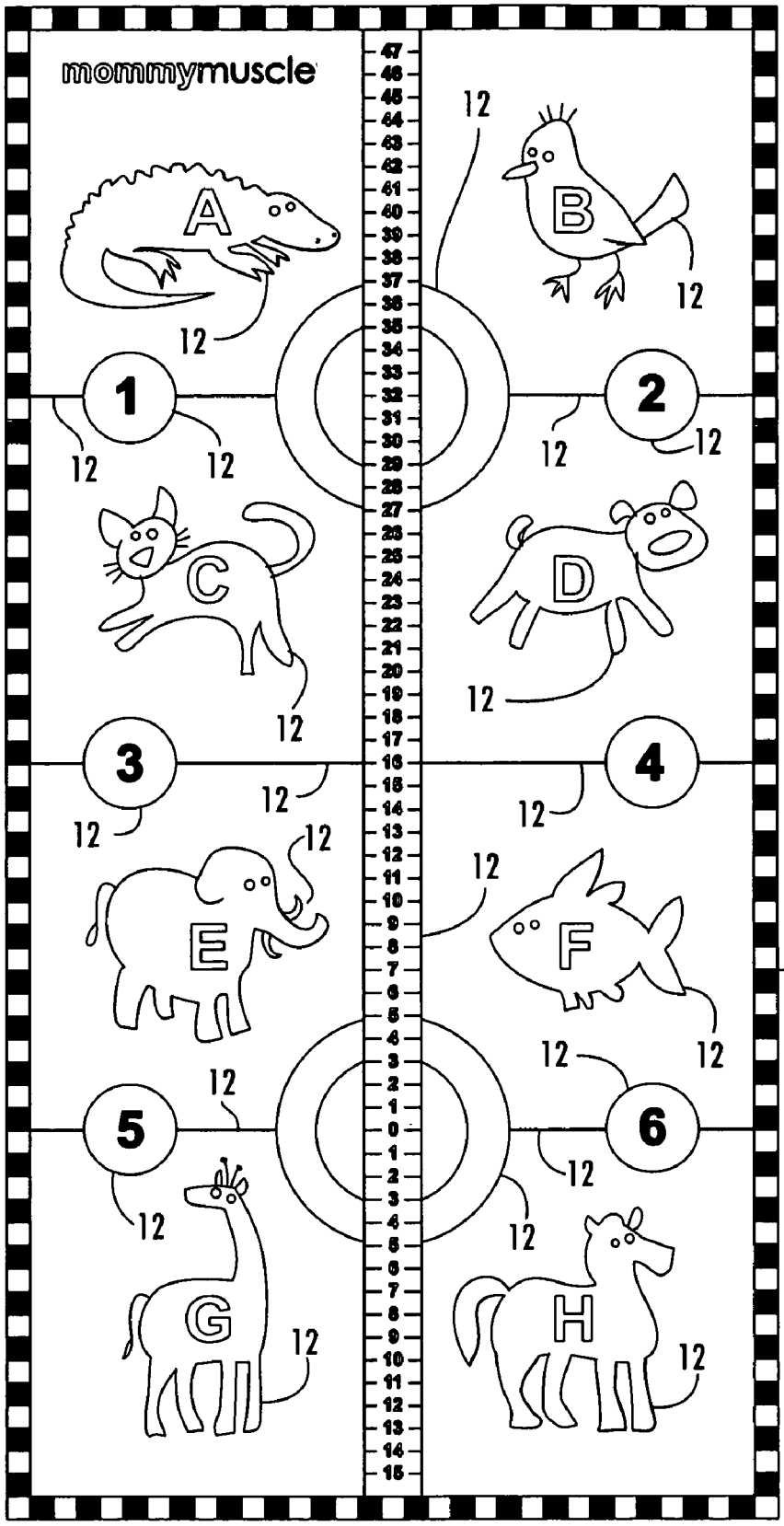
FIG. 1 shows an exemplary exercise mat for use with a system for exercise and/or child development.

The present inventions comprise systems for exercise addressing the needs of parents of babies, toddlers, and/or young children. For the purposes of promoting an understanding of the principles of the present inventions, reference will now be made to the embodiments illustrated in the drawings, and specific language will be used to describe the same. It will nevertheless be understood that no limitation of the scope of these inventions is thereby intended.

FIG. 1 shows an exemplary exercise mat 10 for use with a system for exercise and/or child development. Mat 10 may be constructed of any suitable material as would occur to one of ordinary skill in the art. It is preferred that mat 10 be water-resistant (at least on the bottom), washable, and cushioned. In an embodiment, mat 10 is 60" long by 30" wide, but such dimensions are not required. Other embodiments of mat 10 may be larger or smaller than 60"×30".

A mat, such as exemplary exercise mat 10 shown in FIG. 1, intended for use with a system for exercise and/or child development according to the present inventions comprises a plurality of indicia that are used by adults and children in programs of exercise and/or child development. Such mat indicia can be used as touch points in an unlimited variation of exercises and child development activities. Preferably such mat indicia are brightly colored to attract the attention of a child.

In the exemplary mat shown in FIG. 1, the mat indicia 12 include lines dividing the mat area into eight rectangles. Other mat indicia 12 include illustrated animals, which are allocated to each rectangle in the exemplary mat shown in FIG. 1. In the exemplary mat shown in FIG. 1, each illustrated animal indicia has a letter indicia in its center that represents the first name of the illustrated animal.

Also shown in the exemplary mat shown in FIG. 1 are mat indicia 12 comprising a numbered ruler ascending and descending in one inch increments. A circle indicia with a number inside it appears on the border between the rectangles. The numbers are 1-6, with one number to a circle. Toward each end of mat 10 are addition mat indicia 12 comprising two small circles within two larger circles.

Figure 2:
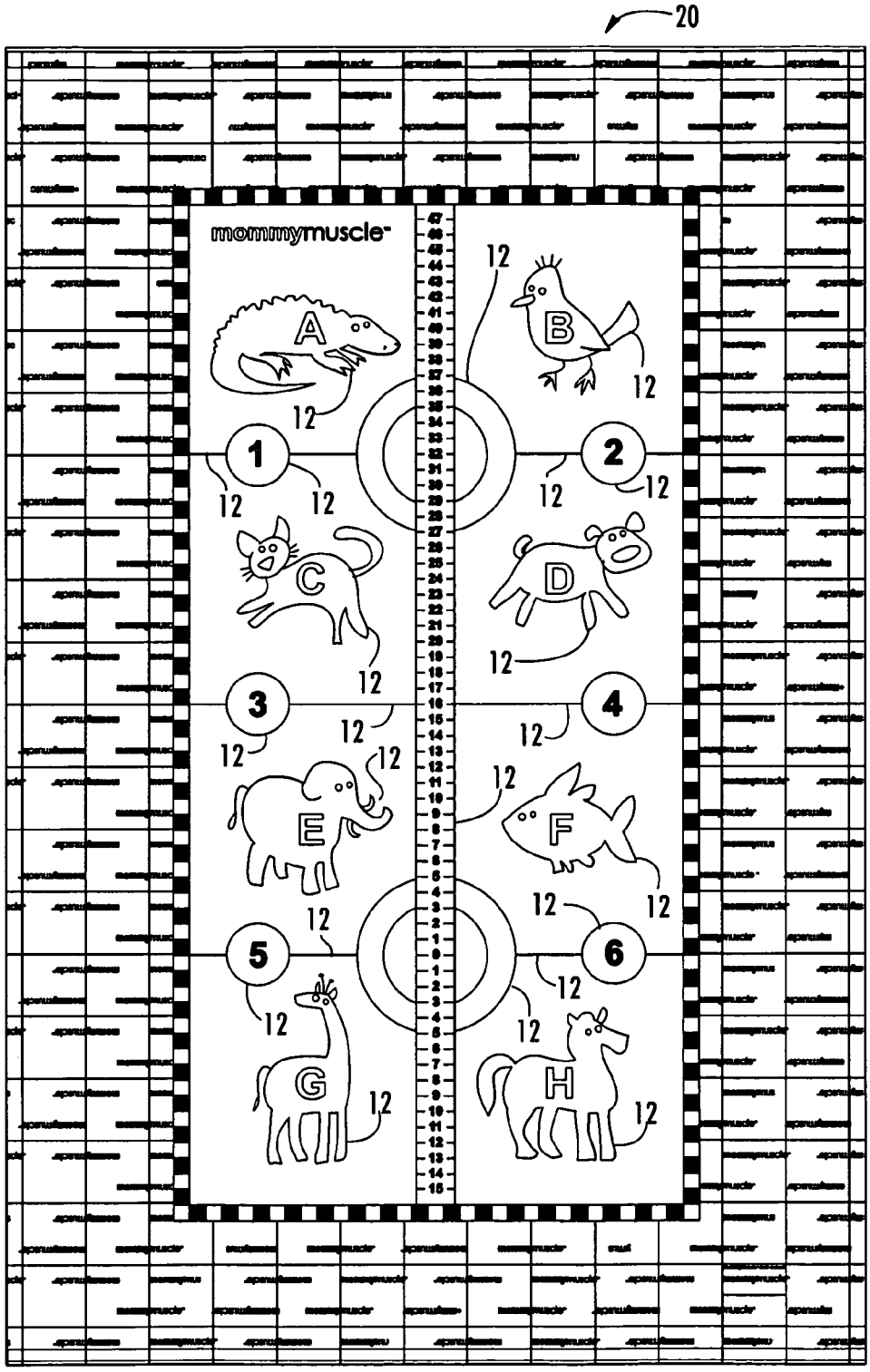
FIG. 2 shows an exemplary exercise mat for use with a system for exercise and/or child development.

FIG. 2 shows exemplary mat 20 for use with a system for exercise and/or child development. Exemplary mat 20 comprises mat indicia 12 incorporated into a foldable "blanket." Such a blanket may be constructed of a digitally-printed brushed tricot polyester-faced fabric. The fabric is quilted to an 8-12 ounce per square yard non-woven batting. The batting is sewn to a coated warp knit or woven polyester backing fabric. The digitally-printed fabric is quilted to the non-woven batting in roll form, and cut to the required length. The cut quilt package is attached to the backing fabric by stitching with polyester filament thread. The backing material may be lapped forward onto the face of the blanket forming an edge border prior to stitching.

Other mats for use with a system for exercise and/or child development according to the present invention may be constructed of a more rigid foam material, or such other material as may occur to one of skill in the art that preferably is washable and cushioned.

FIGS. 3A-8B show examples of exercises according to a system for exercise and/or child development. It is noted that the child shown in FIGS. 3A-8B is an older infant child, but a system for exercise and/or child development according to the present invention may be adapted for a younger infant, a toddler, or an older child.

Figure 3A:
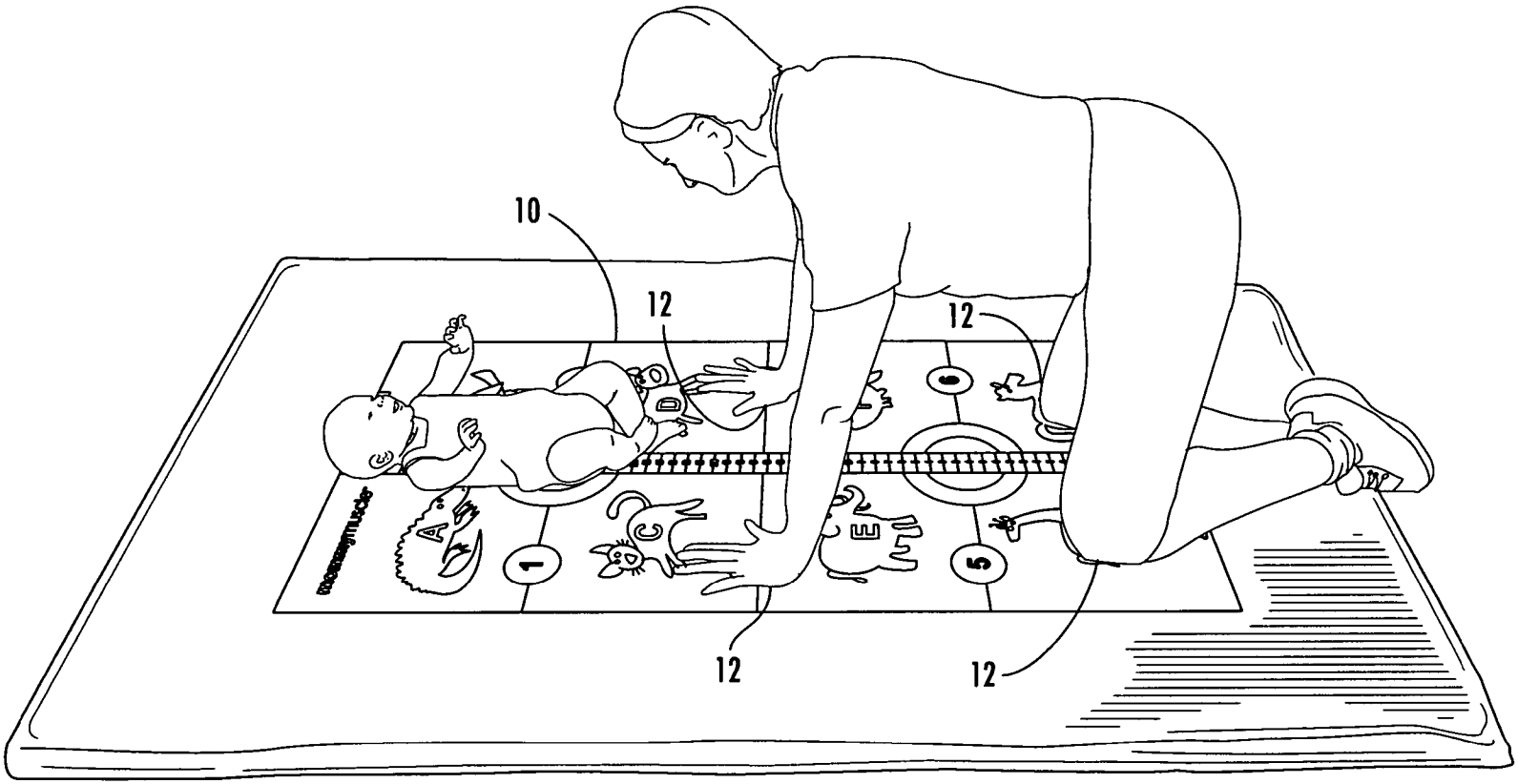
FIGS. 3A-B show an adult and child engaging in an exemplary exercise and/or child development activity.
Figure 3B:
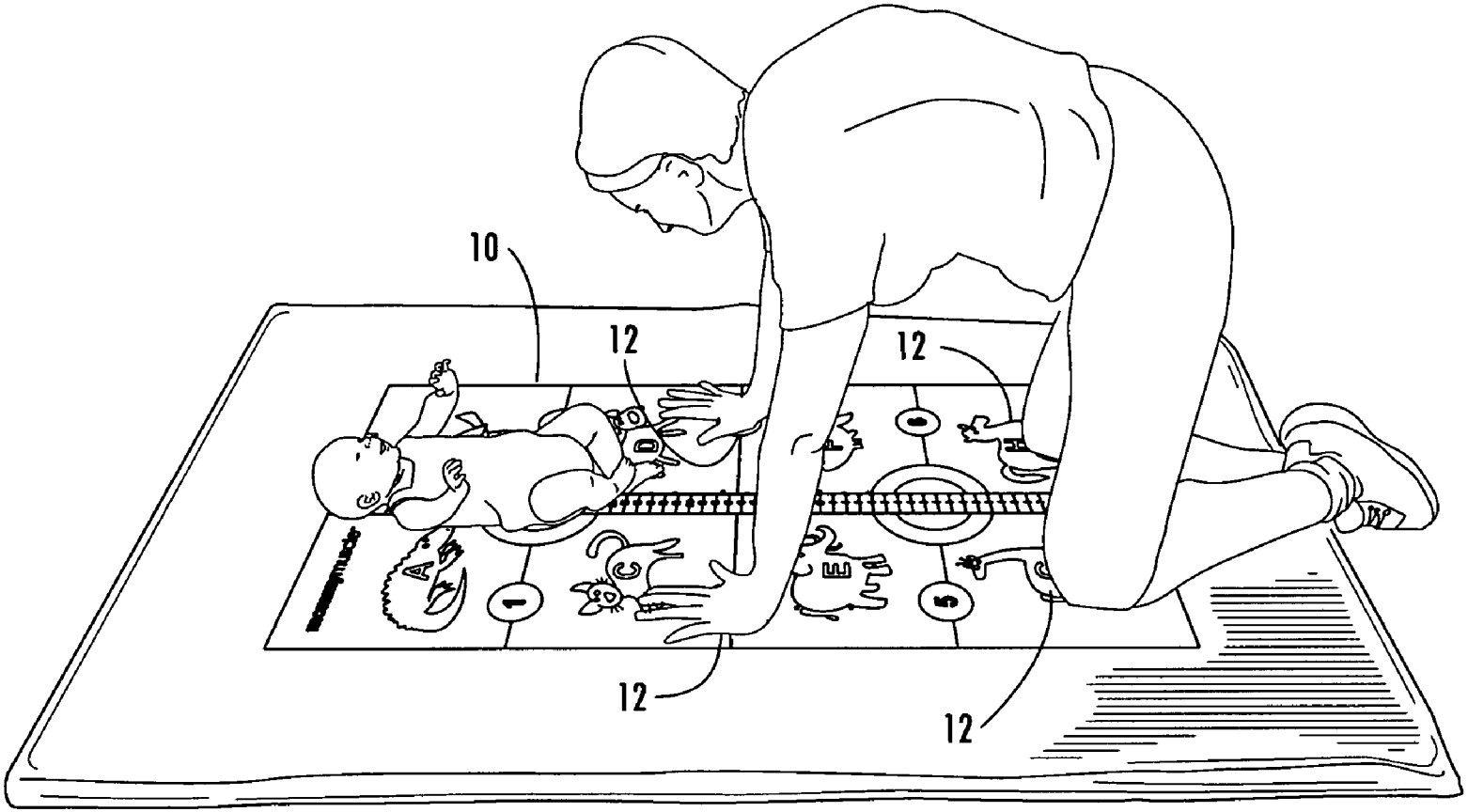

Shown in FIGS. 3A-B are an adult and child engaging in an exemplary exercise and/or child development activity called "cat stretch." As shown in FIG. 3A, the adult assumes a "hands and knees" position on mat 10, facing the child and making eye contact with the child. The adult's hands and knees are placed on indicia 12 on mat 10. As shown in FIG. 3B, while in this position the adult rounds his/her back. This position is held for a predetermined period of time, then released and repeated. As appropriate for the child's developmental age, the adult engages the child in a discussion of the indicia 12 upon which the adult's hands and knees are placed and other indicia 12. The adult may ask questions related to the exercise and appropriate for the child's developmental age, such as, for example: "Can you point to the cat?"; "What sounds does a cat make?"; What letter does cat begin with?"; "What words rhyme with cat?"; and the like. The child also may be encouraged to mimic the adult's actions, although this is not shown in FIGS. 3A-B. If appropriate for the child's developmental age, the child may utilize a child-sized version of mat 10. Such a mat need not be an exact replica of the adult-sized version of mat 10.

Figure 4A:
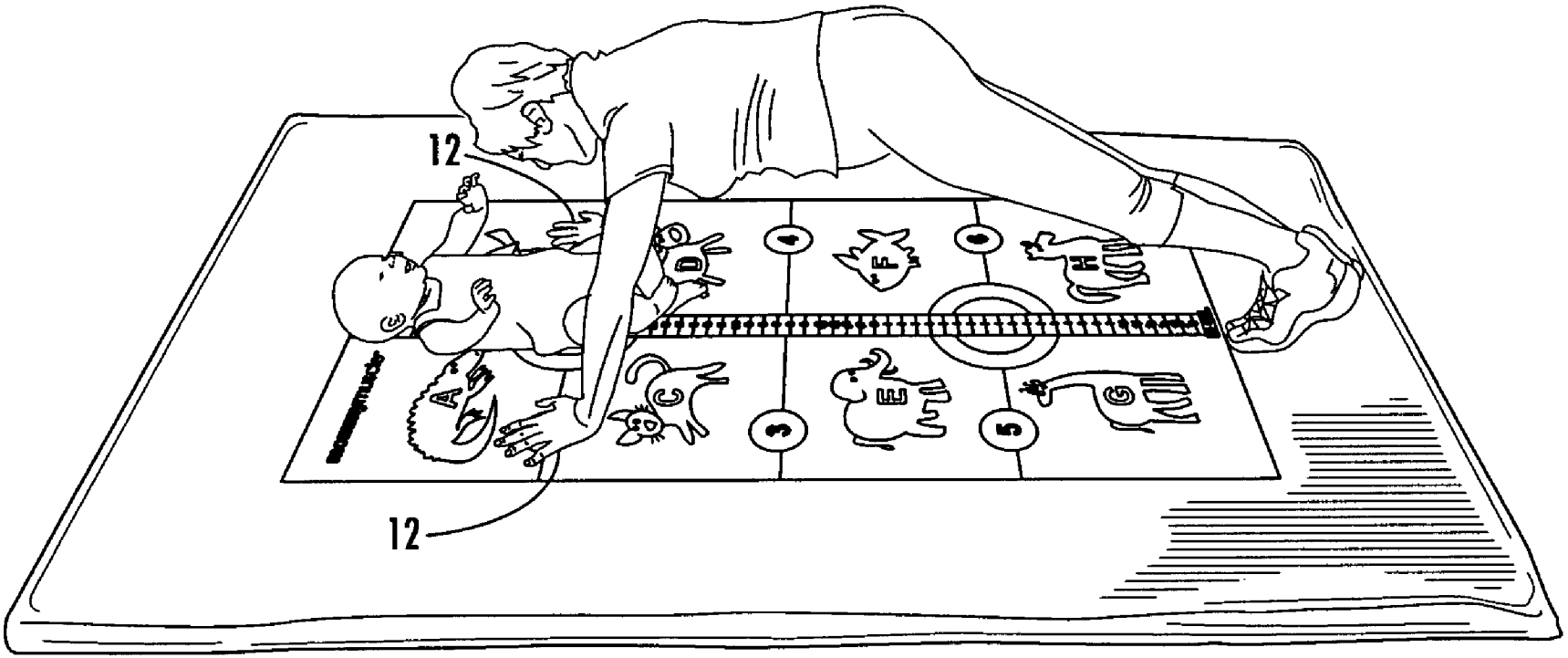
FIGS. 4A-C show an adult and child engaging in an exemplary exercise and/or child development activity.
Figure 4B:
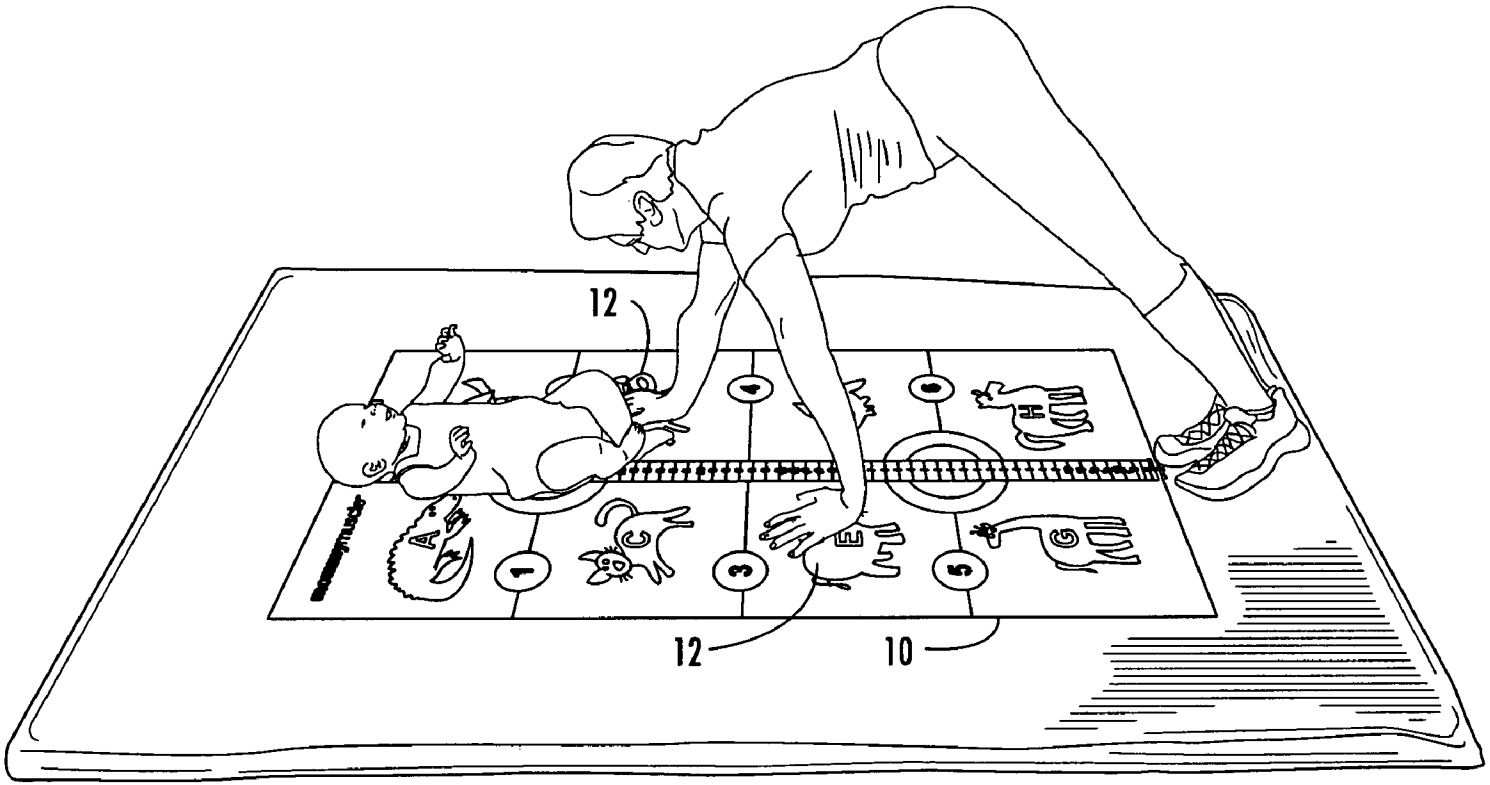
Figure 4C:
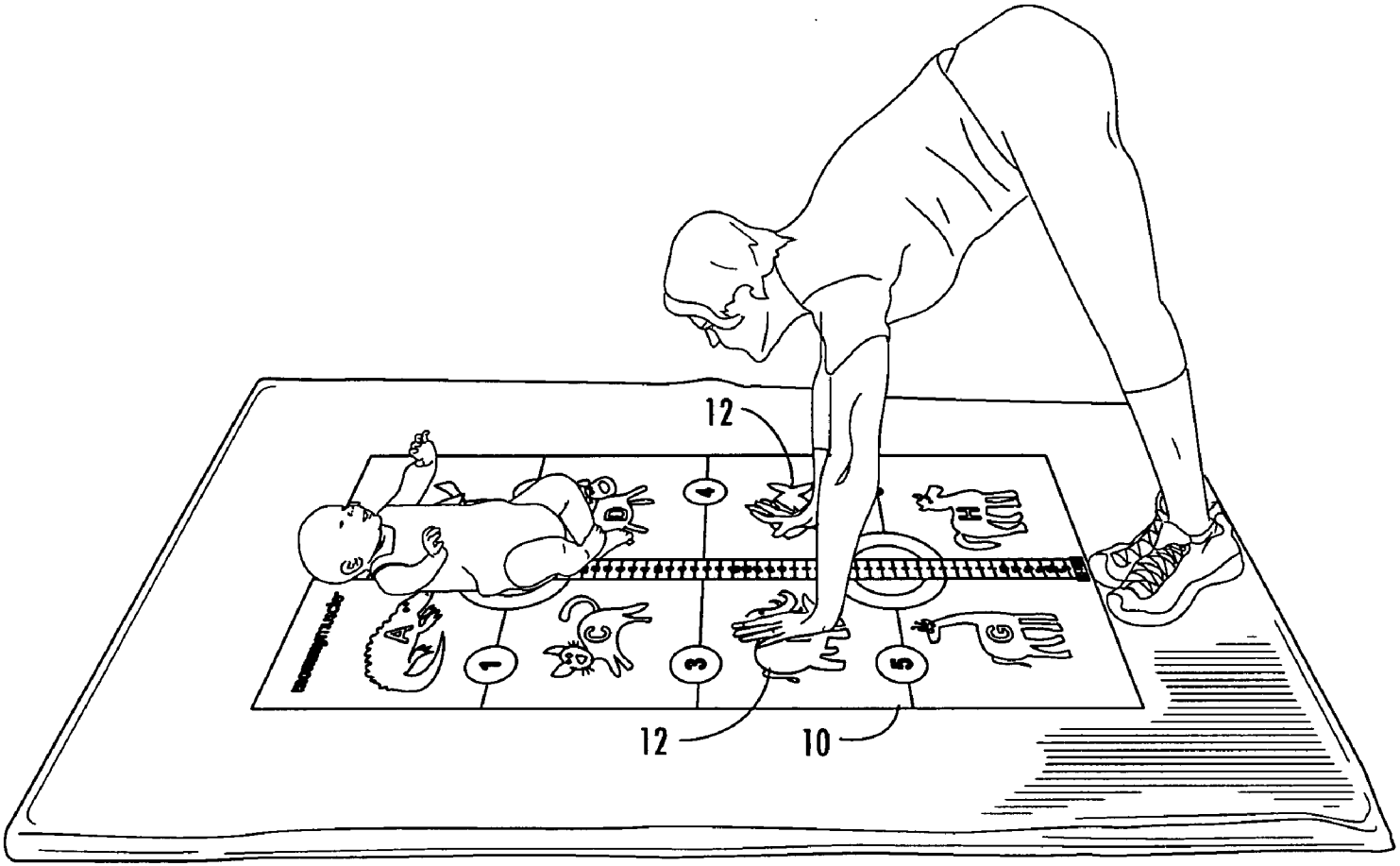

Shown in FIGS. 4A-C are an adult and child engaging in an exemplary exercise and/or child development activity called "downward dog." As shown in FIG. 4A, while facing the child and making eye contact with the child, the adult assumes a position on mat 10. The adult's hands are placed on indicia 12 on mat 10. If possible, the adult's feet also are placed on indicia 12 on mat 10, although the adult's size may preclude this and this arrangement is not shown in FIGS. 4A-C. As shown in FIGS. 4B-C, from this position the adult "walks" his/her hands toward his/her feet, placing his/her hands on various indicia 12 in the process. As appropriate for the child's developmental age, the adult engages the child in a discussion of the indicia 12 upon which the adult's hands are placed, and other indicia 12. The adult may ask questions related to the exercise and appropriate for the child's developmental age, such as, for example: "Can you point to the dog?"; "What sounds does a dog make?"; What letter does 'dog' begin with?"; "What words rhyme with dog?"; and the like. The child also may be encouraged to mimic the adult's actions, although this is not shown in FIGS. 4A-C. If appropriate for the child's developmental age, the child may utilize a child-sized version of mat 10. Such a mat need not be an exact replica of the adult-sized version of mat 10.

Figure 5A:
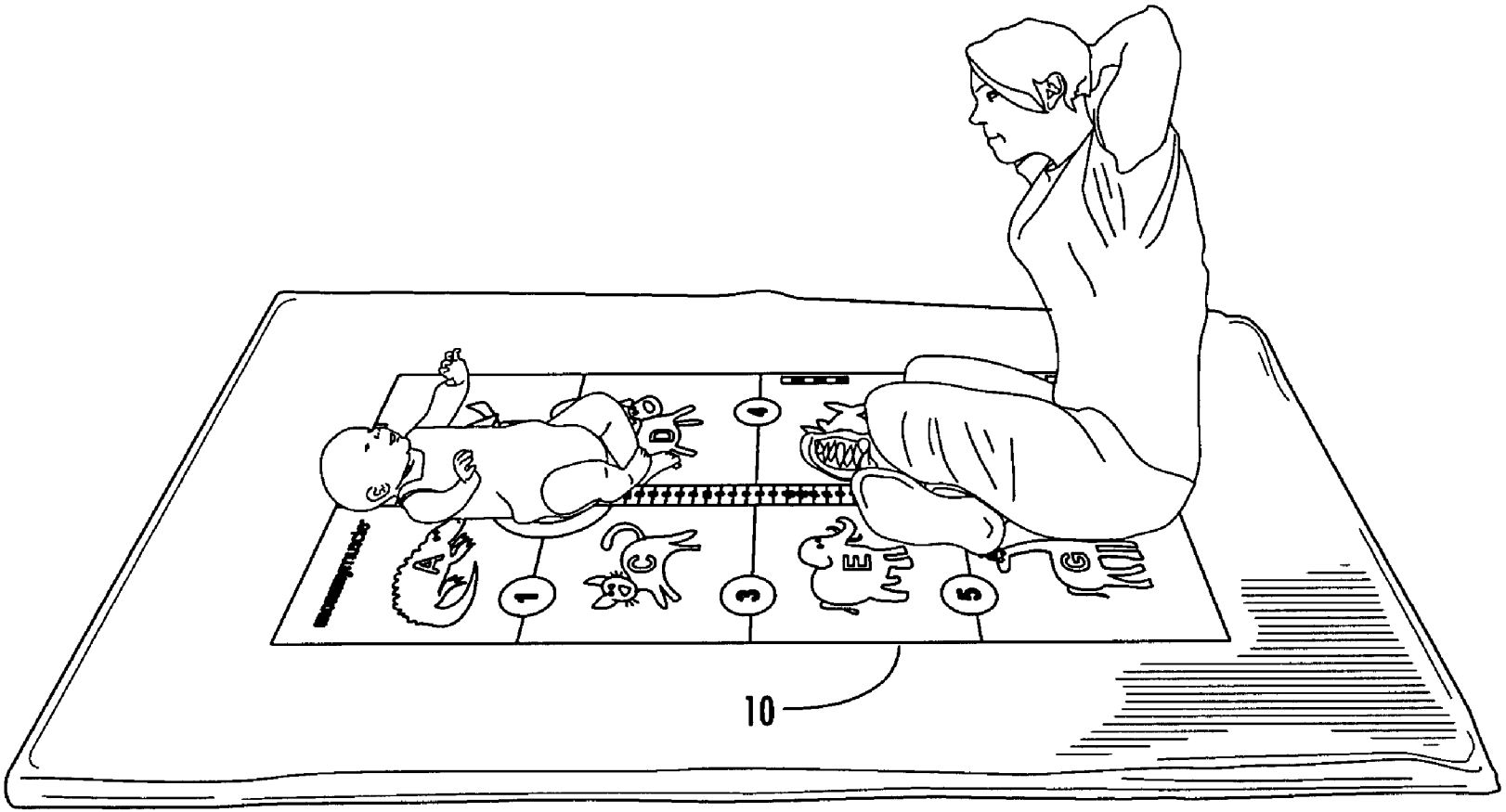
FIGS. 5A-B show an adult and child engaging in an exemplary exercise and/or child development activity.
Figure 5B:
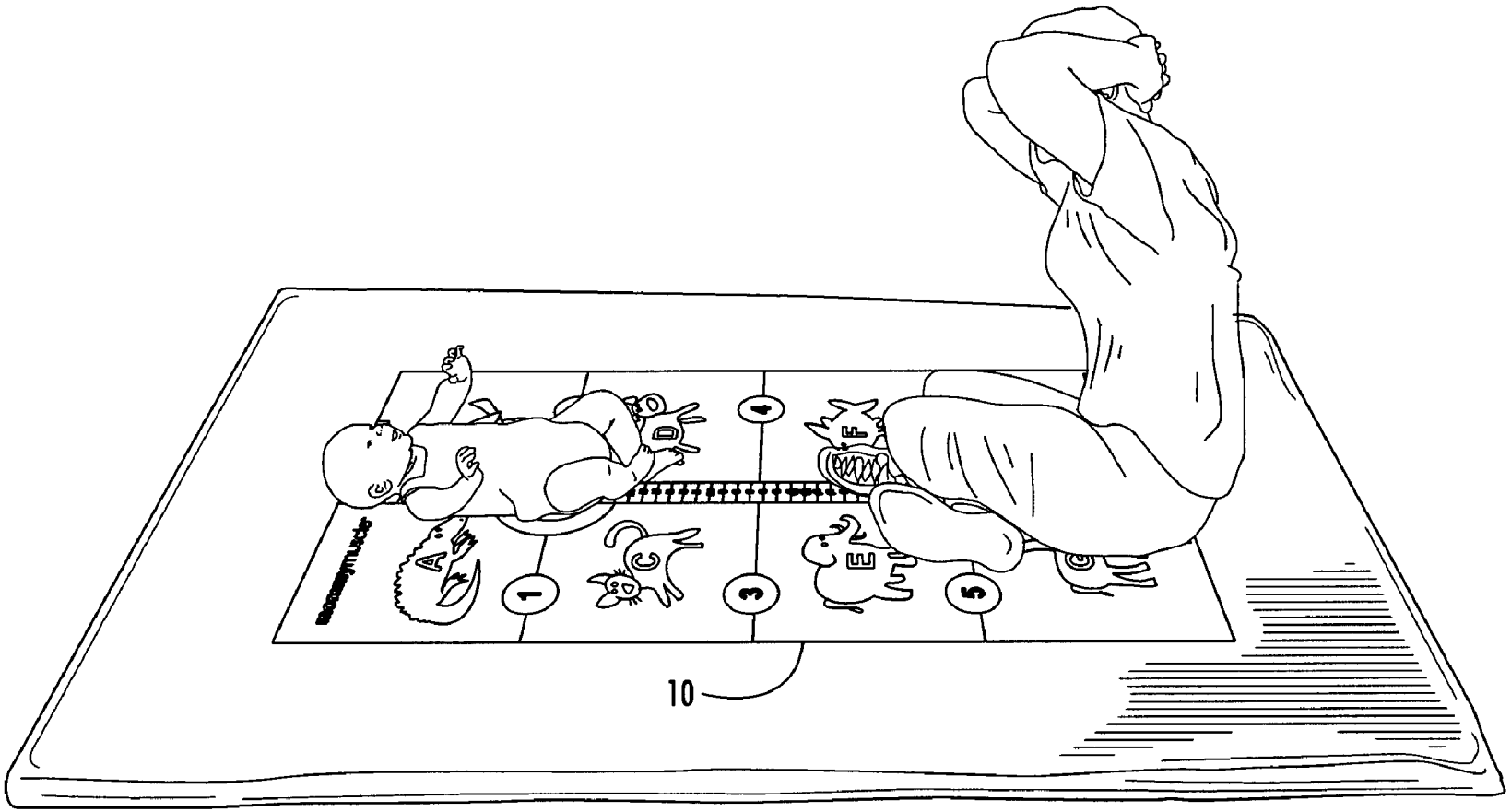

Shown in FIGS. 5A-B are an adult and child engaging in an exemplary exercise and/or child development activity called "elephant ears." As shown in FIG. 5A, while facing the child and making eye contact with the child, the adult sits upon indicia 12 on mat 10 with his/her legs crossed. The adult's hands are placed behind his/her head, with elbows extended. While keeping his/her hands in contact with the back of his/her head, the adult attempt to bring his/her elbows together. As appropriate for the child's developmental age, the adult engages the child in a discussion of the indicia 12 upon which the adult is seated, or other indicia 12 on the mat. The adult may ask questions related to the exercise and appropriate for the child's developmental age, such as, for example: "Can you point to the elephant?"; "What sound does an elephant make?"; What letter does 'elephant' begin with?"; "What other words begin with 'E'?"; and the like. The child also may be encouraged to mimic the adult's actions, although this is not shown in FIGS. 5A-B. If appropriate for the child's developmental age, the child may utilize a child-sized version of mat 10. Such a mat need not be an exact replica of the adult-sized version of mat 10.

Figure 6A:
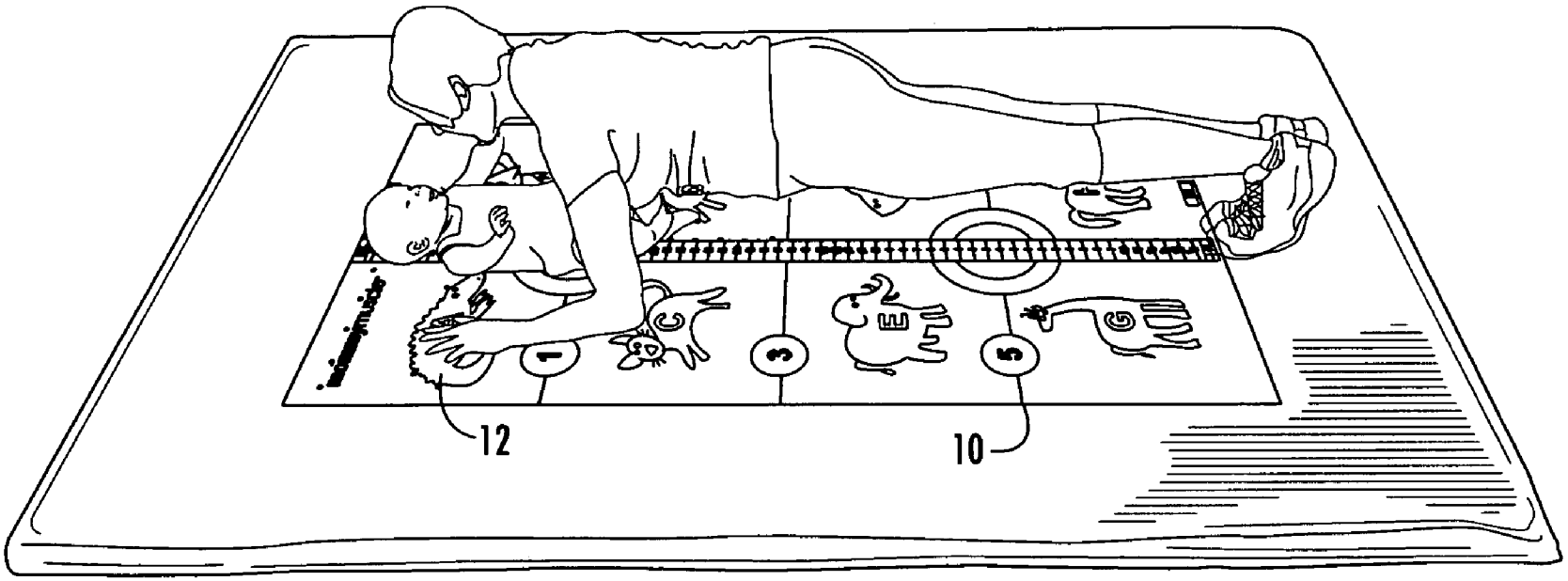
FIGS. 6A-D show an adult and child engaging in an exemplary exercise and/or child development activity.
Figure 6B:
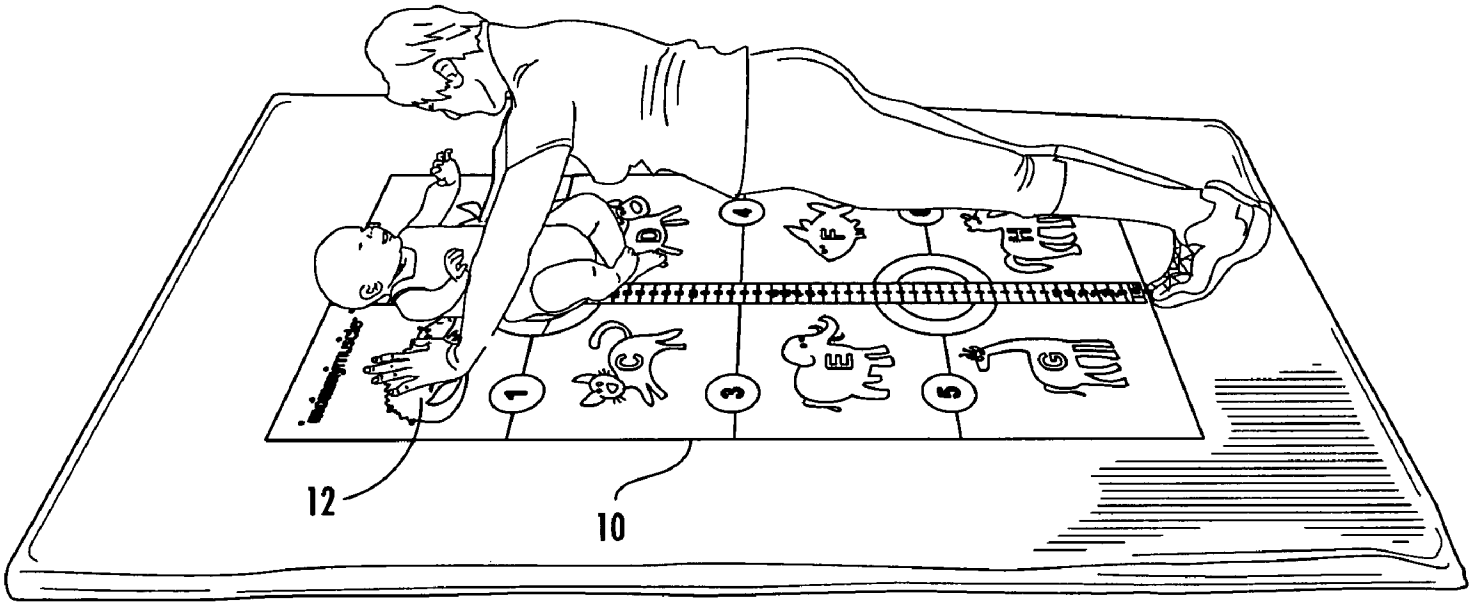
Figure 6C:
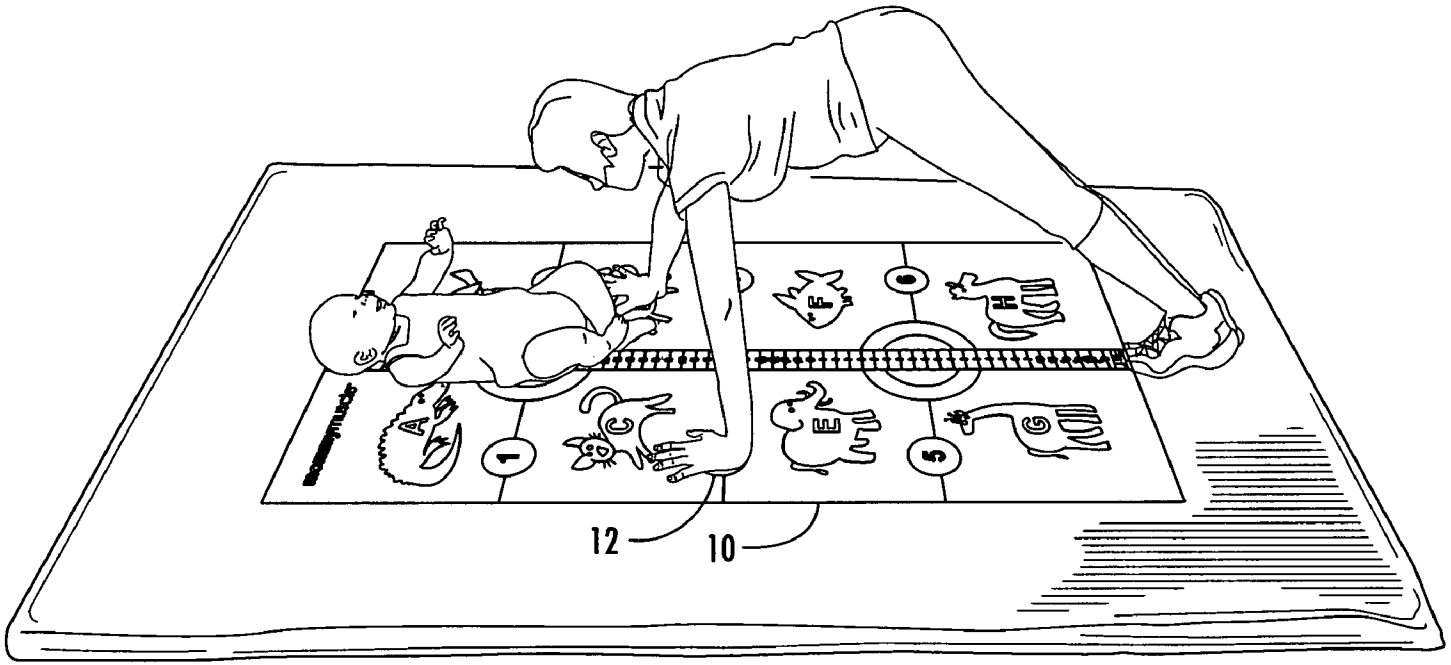
Figure 6D:
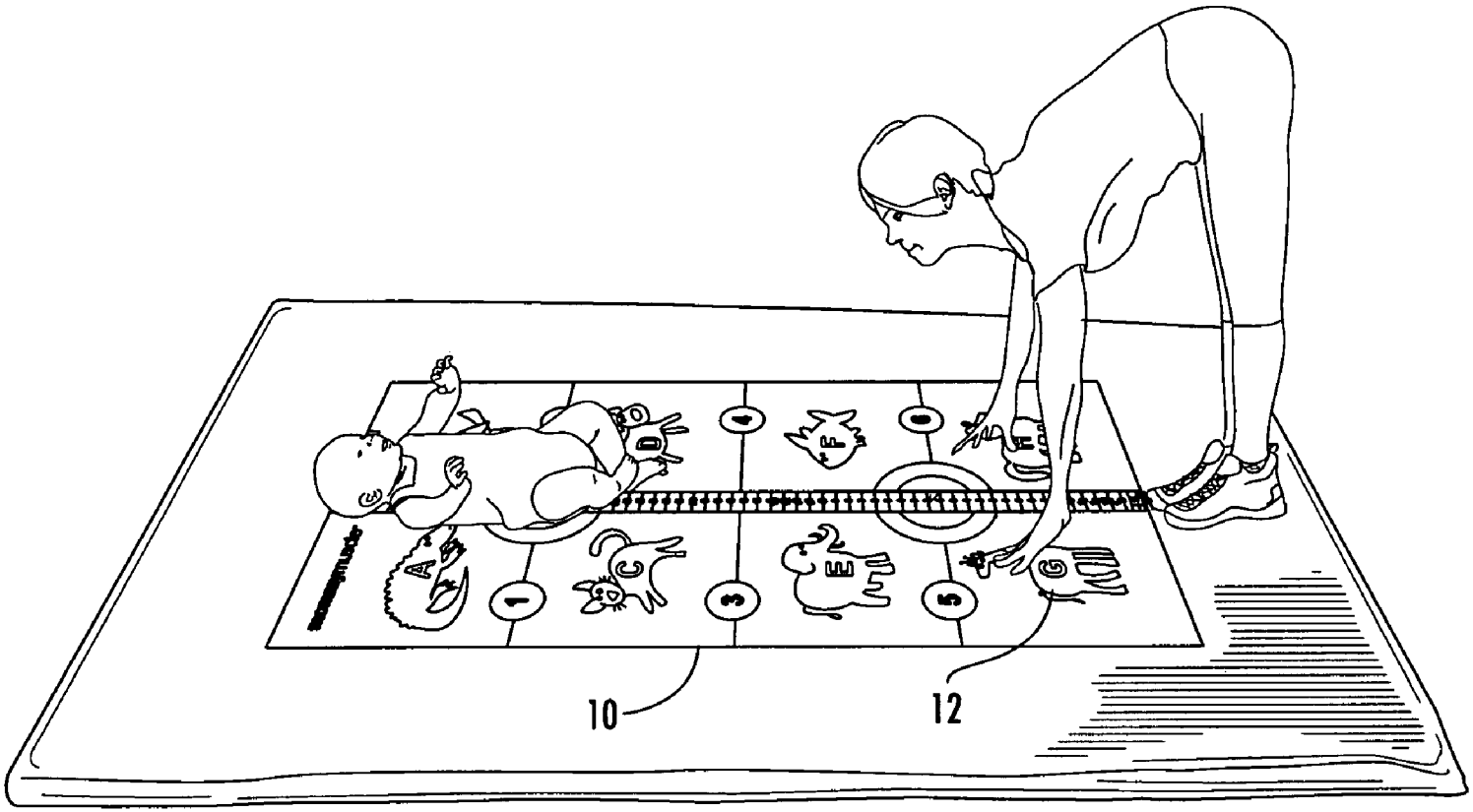

Shown in FIGS. 6A-D are an adult and child engaging in an exemplary exercise and/or child development activity called "plank to walk up." As shown in FIG. 6A, while facing the child and making eye contact with the child, the adult supports his/her body weight on his/her elbows and toes, and keeps his/her body in a line substantially parallel to mat 10. The adult's elbows and/or hands preferably are placed on indicia 12 on mat 10. If possible, the adult's feet also are placed on indicia 12 on mat 10, although the adult's size may preclude this and this arrangement is not shown in FIGS. 6A-D. As shown in FIG. 6B, while facing the child and making eye contact with the child, the adult pushes his/her body away from the mat to a position with his/her arms extended, preferably placing his/her hands on indicia on the mat in the process. From this position, as shown in FIGS. 6C-D, the adult "walks" his/her hands toward his/her feet, placing his/her hands on various indicia 12 in the process. As appropriate for the child's developmental age, the adult engages the child in a discussion of the indicia 12 upon which the adult's hands are placed or other indicia 12. The child also may be encouraged to mimic the adult's actions, although this is not shown in FIGS. 6A-D. If appropriate for the child's developmental age, the child may utilize a child-sized version of mat 10. Such a mat need not be an exact replica of the adult-sized version of mat 10.

Figure 7A:
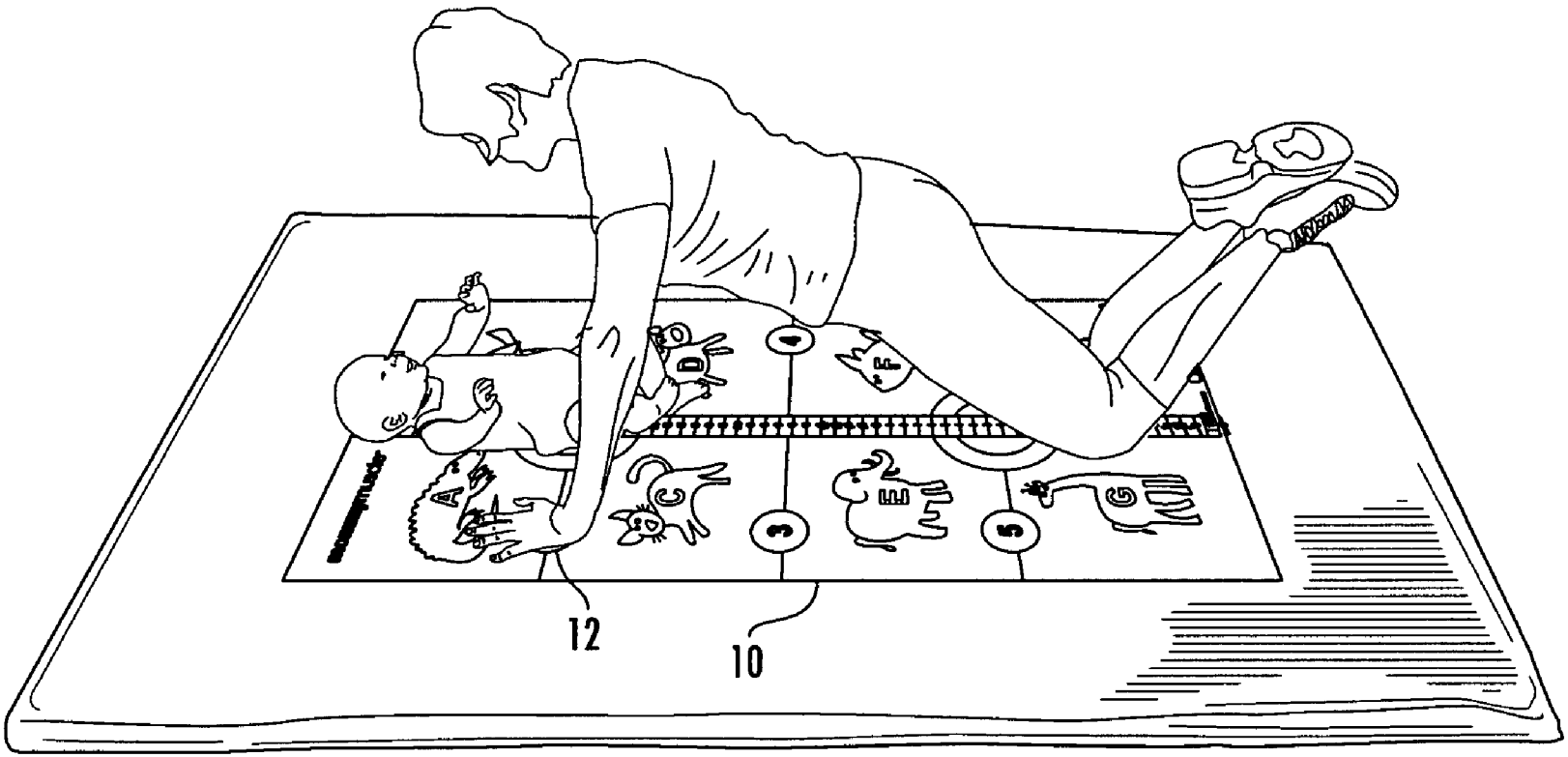
FIGS. 7A-B show an adult and child engaging in an exemplary exercise and/or child development activity.
Figure 7B:
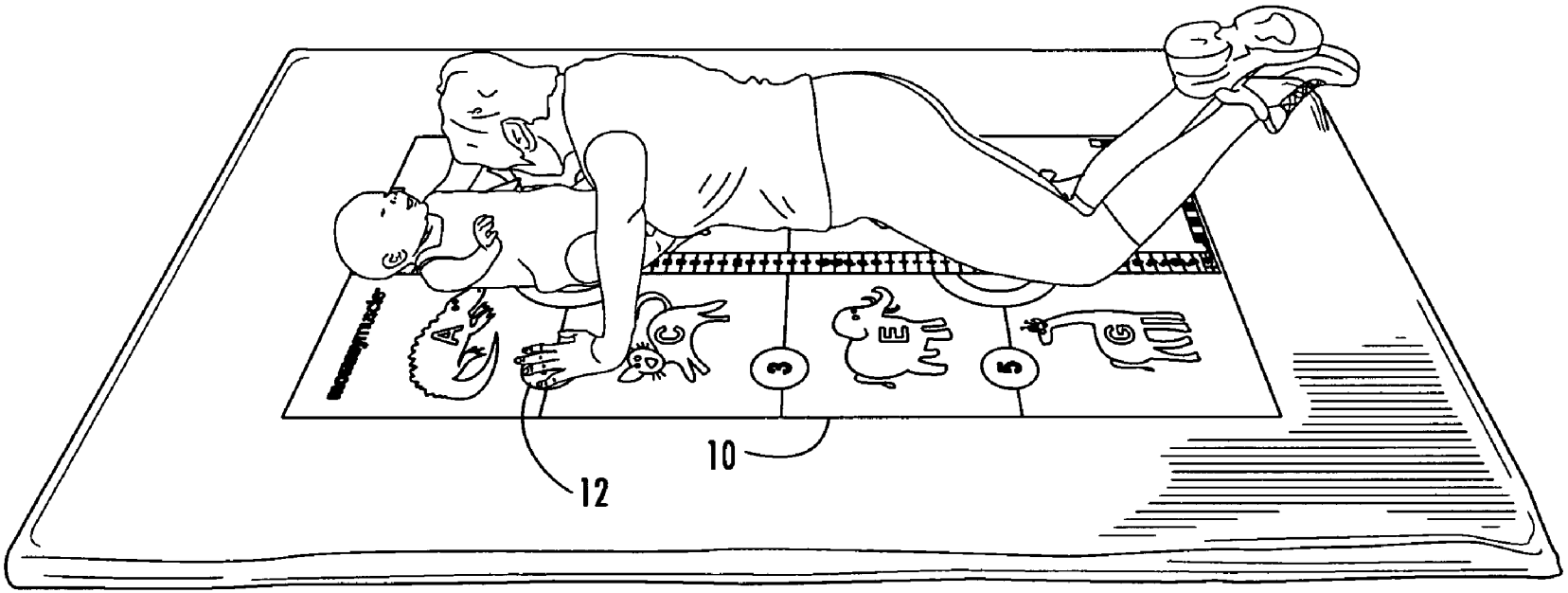

Shown in FIGS. 7A-B are an adult and child engaging in an exemplary exercise and/or child development activity called "push up." As shown in FIG. 7A, while facing the child and making eye contact with the child, the adult assumes a position with the adult's hand and knees in contact with mat 10. The adult's hands and knees (or feet) are placed on indicia 12 on mat 10. From this position, as shown in FIG. 7B, the adult lowers his/her body toward the mat, keeping his/her hips in line with his/her shoulders and his/her ankles. The adult then raises his/her body back to the starting position. As appropriate for the child's developmental age, the adult engages the child in a discussion of the indicia 12 upon which the adult's hands are placed or other indicia 12. The child also may be encouraged to mimic the adult's actions, although this is not shown in FIGS. 7A-B. If appropriate for the child's developmental age, the child may utilize a child-sized version of mat 10. Such a mat need not be an exact replica of the adult-sized version of mat 10.

Figure 8A:
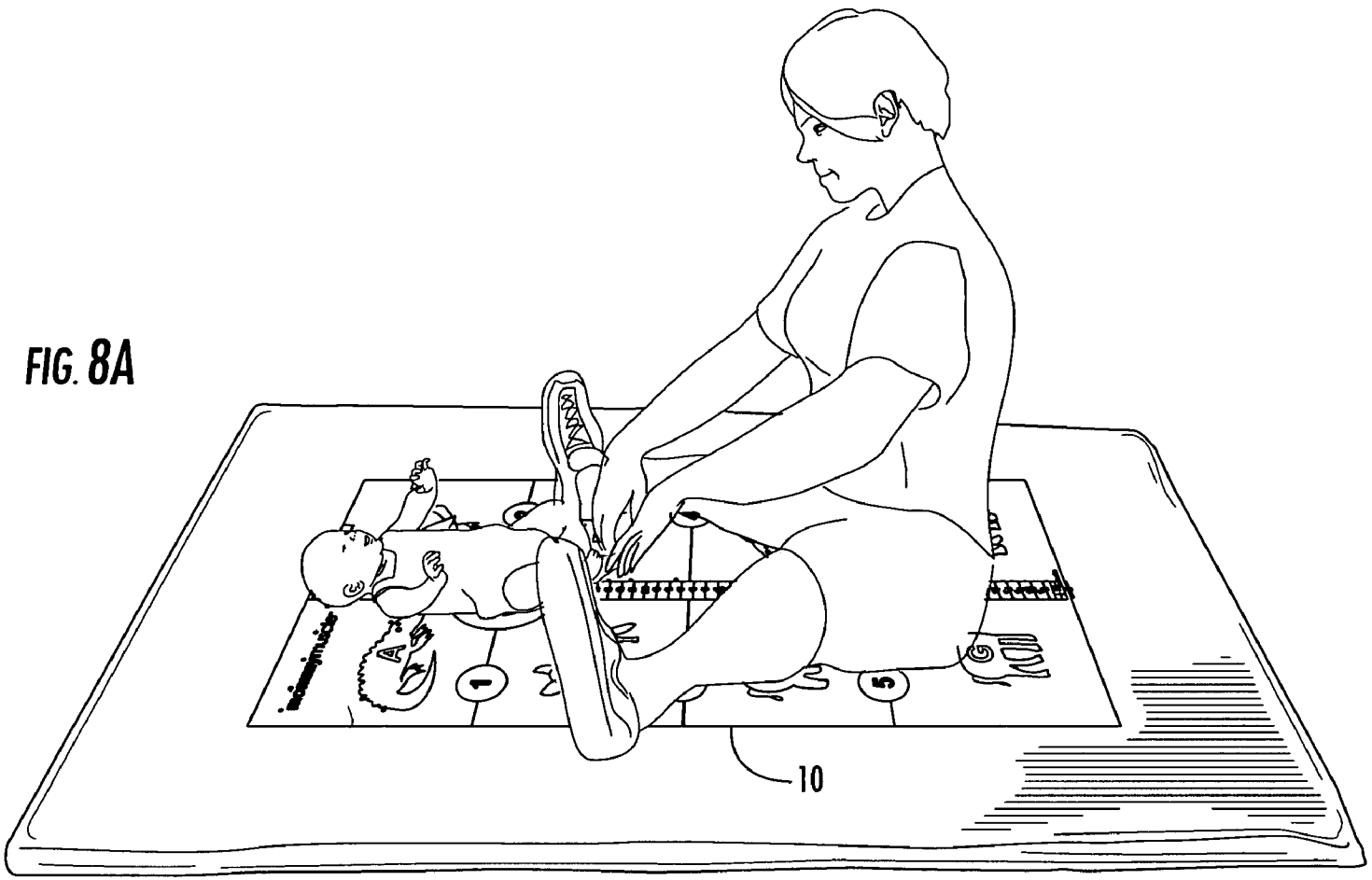
FIGS. 8A-B show an adult and child engaging in an exemplary exercise and/or child development activity.
Figure 8B:
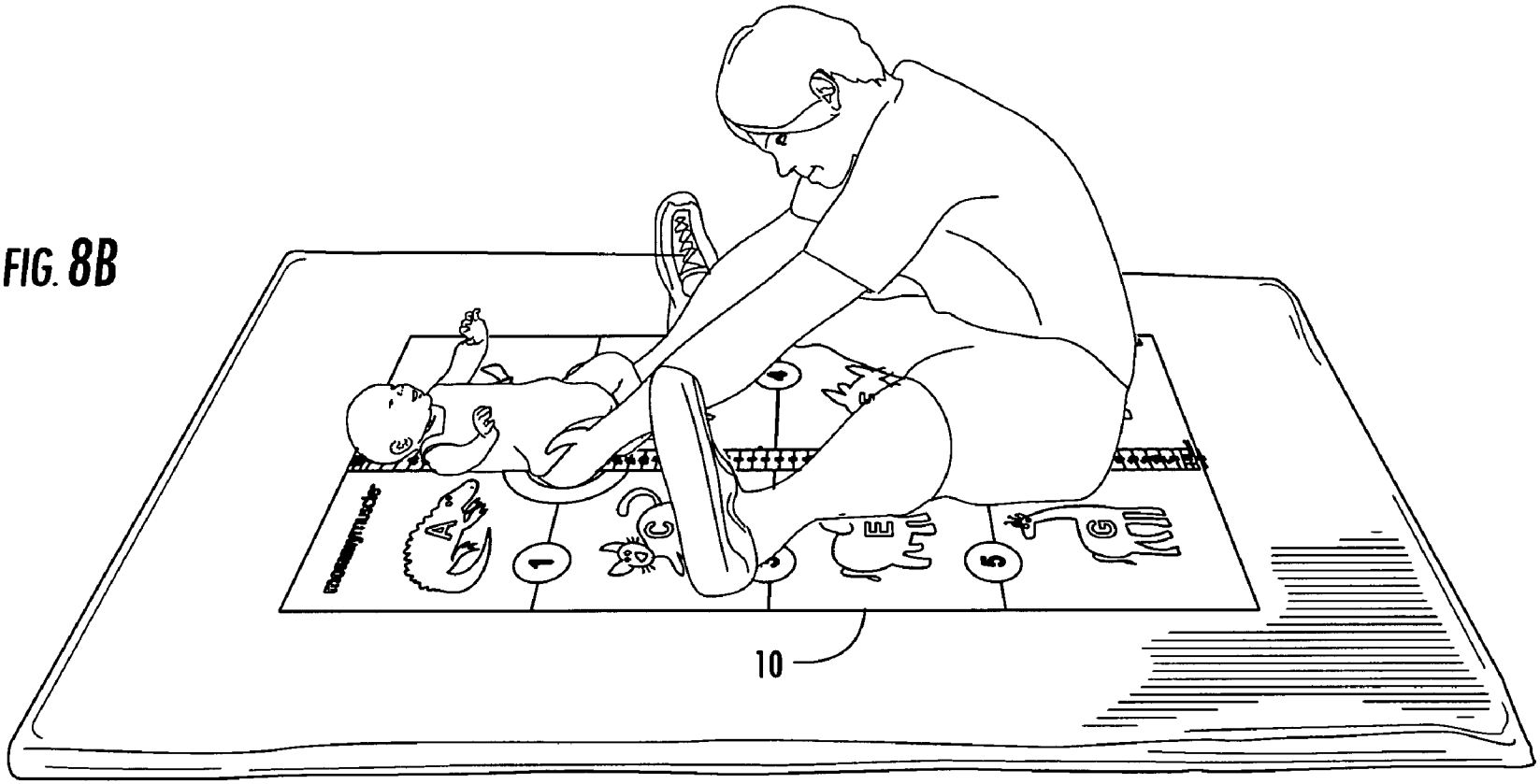

Shown in FIGS. 8A-B are an adult and child engaging in an exemplary exercise and/or child development activity called "straddle stretch." As shown in FIG. 8A, while facing the child and making eye contact with the child, the adult sits upon an indicia 12 on mat 10 with his/her legs extended to each side. As shown in FIG. 8B, the adult tips forward and extend his/her hands to touch various other indicia 12. As appropriate for the child's developmental age, the adult preferably engages the child in a discussion of the indicia 12 upon which the adult's hands are placed, or other indicia 12. The child also may be encouraged to mimic the adult's actions, although this is not shown in FIGS. 8A-B. If appropriate for the child's developmental age, the child may utilize a child-sized version of mat 10. Such a mat need not be an exact replica of the adult-sized version of mat 10.

Systems for exercise and/or child development according to the present inventions may comprise external prompts which direct the actions of an adult and a child. For example, where such a system for exercise and/or child development comprises the use of a mat with indicia, an external prompt comprising a set of cards may be used. Such a set of cards comprises indicia corresponding to the indicia appearing on the mat. When a card is drawn from the set, the adult and child are instructed to engage in an exercise or child development activity having some relation to the indicia appearing on the card. For example, one side of the card could have a picture of a mat indicia, and the other side of the card could have a description of an exercise, or child development activity in which the adult and/or child are to engage. Such exercises and child development activities could be of the type where the child directs the adult, and others could be of the type where the adult directs the child. Such external prompts are not limited to an implementation in a set of cards format. Such external prompts may be implemented in a DVD, CD, audiotape, videotape, book, or computer program, or in such other media as would occur to one skilled in the art.

In a first specific example, an external prompt comprising a card may contain indicia representing an illustrated bird. The adult may instruct the child to "find the birdy," and the child in response will find the card with the bird indicia and place it on the mat on the corresponding bird indicia found thereon. The reverse side of the card may then have an exercise for the adult and child.

In a second specific example, exercises and/or child development activities described by an external prompt comprising a card all begin with a letter indicia that appears on the front of the card.

In a third specific example, an animal indicia appears on the face of an external prompt comprising a card, and the instructions on the reverse side of the card comprise exercises and/or child development activities reflecting the actions of such an animal. Such exercises may incorporate fitness movements from yoga, pilates, or other forms of exercise. Sounds made by the animal may be integrated into the activity.

In a fourth specific example, the adult and child may engage in a version of the well-known game of "Twister." An external prompt comprising a card directs the placement of the adult and child participants' hands and feet on certain indicia, which the adult and child participants perform while attempting to maintain their balance.

In a fifth specific example involving animal indicia, the animal indicia of an external prompt encourages the adult and child to invent stories involving the animal shown on by the external prompt, while incorporating fitness and child development activities such as, for example, standing on the animal indicia while telling that part of the story, naming colors, and incorporating songs such as "Old McDonald."

Systems for exercise and/or child development according to the present inventions may be used in a setting comprising a single adult and one or more children, or may be used in a setting comprising a plurality of adults and children. In such a setting comprising a plurality of adults and children, the plurality of adults and children may be simultaneously performing the same exercise and/or child development activities.

While this application discloses certain preferred designs and methods, the designs and methods disclosed herein can be further modified within the scope and spirit of this disclosure. This application is therefore intended to cover any variations, uses, or adaptations of such designs and methods using their general principles. For example, the methods disclosed herein and in the appended claims represent only one possible sequence of performing the steps thereof. A practitioner of the present inventions may determine in a particular implementation of the present inventions that multiple steps of one or more of the disclosed methods may be combinable, or that a different sequence of steps may be employed to accomplish the same results. Each such implementation falls within the scope of the present inventions as disclosed herein and in the appended claims. Furthermore, this application is intended to cover such departures from the present disclosure as come within known or customary practice in the art to which these inventions pertain and which fall within the limits of the appended claims.

We claim:

1. A method for adult exercise and child development for concurrent use by an adult and a child, the method comprising the steps of:

providing a prompt;

providing a mat comprising a first surface, said first surface sized to permit an adult to perform exercises and a child to engage in a child development activity concurrently thereon, said first surface comprising a first plurality of indicia;

providing instructions describing at least one combined adult exercise and child development activity using said first surface; and directing performance of said at least one combined adult exercise and child development activity in accordance with said instructions, wherein said adult and said child are facing each other during at least a portion of said at least one combined adult exercise and child development activity, and wherein said at least one combined adult exercise and child development activity comprises placing at least one body part of said adult in contact with at least one of said first plurality of indicia and instructing said child to react to said prompt that corresponds to said at least one of said first plurality of indicia.

2. The method of claim 1, further comprising the step of:

providing a second surface, said second surface sized to permit a child to perform exercises thereon, said second surface comprising a second plurality of indicia.

* * * * *